US008931466B2

(12) United States Patent
Immesberger et al.

(10) Patent No.: US 8,931,466 B2
(45) Date of Patent: Jan. 13, 2015

(54) BOWSTRING DRAWING AND RELEASE ASSIST APPARATUS AND METHOD THEREOF

(71) Applicants: Daniel Immesberger, Bohemia, NY (US); Lisa Collins, Bohemia, NY (US)

(72) Inventors: Daniel Immesberger, Bohemia, NY (US); Lisa Collins, Bohemia, NY (US)

( * ) Notice: Subject to any disclaimer, the term of this patent is extended or adjusted under 35 U.S.C. 154(b) by 0 days.

(21) Appl. No.: 13/890,291

(22) Filed: May 9, 2013

(65) Prior Publication Data

US 2014/0150765 A1 Jun. 5, 2014

Related U.S. Application Data

(60) Division of application No. 13/367,677, filed on Feb. 7, 2012, now Pat. No. 8,453,632, which is a continuation of application No. 12/133,618, filed on Jun. 5, 2008, now abandoned.

(60) Provisional application No. 60/942,057, filed on Jun. 5, 2007.

(51) Int. Cl.
*F41B 5/18* (2006.01)
*F41B 5/14* (2006.01)

(52) U.S. Cl.
CPC ..... *F41B 5/1469* (2013.01)
USPC ..... 124/35.2; 124/23.1; 124/25.6; 124/32; 124/44.5; 124/86; 124/88; 124/90

(58) Field of Classification Search
CPC ..... F41B 5/1469
USPC ..... 124/23.1, 25.6, 32, 35.2, 44.5, 86, 88, 124/90
See application file for complete search history.

(56) References Cited

U.S. PATENT DOCUMENTS

| | | | | | |
|---|---|---|---|---|---|
| 2,664,078 | A | * | 12/1953 | Irwin | 124/24.1 |
| 3,208,653 | A | | 9/1965 | Wallace | |
| 3,416,220 | A | | 12/1968 | Wilson | |
| 3,561,418 | A | * | 2/1971 | Fredrickson | 124/24.1 |
| 3,895,621 | A | * | 7/1975 | Kellogg | 124/24.1 |
| 4,103,807 | A | | 8/1978 | Lyon et al. | |
| 4,332,233 | A | | 6/1982 | Knoble | |
| 4,603,676 | A | * | 8/1986 | Luoma | 124/25 |
| 4,615,326 | A | * | 10/1986 | Rathbun | 124/88 |
| 4,684,047 | A | | 8/1987 | Burgwin | |
| 4,823,761 | A | | 4/1989 | Lewis | |
| 4,854,293 | A | * | 8/1989 | Roberts | 124/35.2 |
| 4,949,698 | A | | 8/1990 | Burnham | |
| 4,981,128 | A | * | 1/1991 | Garvison | 124/35.2 |
| 5,000,154 | A | * | 3/1991 | Slayton | 124/23.1 |
| 5,065,730 | A | * | 11/1991 | Kluver | 124/35.2 |
| 5,156,138 | A | * | 10/1992 | Grover | 124/35.2 |

(Continued)

*Primary Examiner* — Kurt Fernstrom
*Assistant Examiner* — Alexander Niconovich
(74) *Attorney, Agent, or Firm* — Carter, DeLuca, Farrell & Schmidt, LLP

(57) ABSTRACT

An apparatus for one-handed operation of archery equipment may facilitate drawing and firing of an arrow from a bow. The apparatus may comprise a release aid having jaws for selective engagement and disengagement of a bowstring and a trigger mechanism operable to open and close the jaws. Head gear may be configured for attachment to the head of an archer and may be coupled to the release aid with a connection mechanism such that the archer may resist a tension in the bowstring with the headgear. An alternative apparatus comprises an automatic drawbar and engagement head such that an archer may manipulate drawbar controls to draw and release an arrow from a bow.

8 Claims, 3 Drawing Sheets

(56) References Cited

U.S. PATENT DOCUMENTS

| | | | | | |
|---|---|---|---|---|---|
| 5,205,268 | A | * | 4/1993 | Savage | 124/24.1 |
| 5,243,957 | A | * | 9/1993 | Neilson | 124/88 |
| 5,247,922 | A | * | 9/1993 | Lalonde | 124/35.2 |
| 5,351,867 | A | | 10/1994 | Vest | |
| D354,393 | S | | 1/1995 | Mocca | |
| 5,465,705 | A | * | 11/1995 | Baeseman | 124/88 |
| 5,487,374 | A | | 1/1996 | Herminath et al. | |
| 5,494,023 | A | | 2/1996 | Kolak | |
| 5,497,512 | A | * | 3/1996 | Wright | 2/102 |
| 5,505,187 | A | | 4/1996 | Troncoso et al. | |
| 5,509,400 | A | | 4/1996 | Chalin | |
| 5,558,077 | A | | 9/1996 | Linsmeyer | |
| 5,575,269 | A | | 11/1996 | Harklau | |
| 5,595,167 | A | | 1/1997 | Scott | |
| 5,598,830 | A | * | 2/1997 | Creel, Sr. | 124/86 |
| 5,649,524 | A | * | 7/1997 | Pullin | 124/86 |
| 5,653,213 | A | | 8/1997 | Linsmeyer | |
| 5,666,936 | A | | 9/1997 | Estrada | |
| 5,671,723 | A | * | 9/1997 | Goff et al. | 124/35.2 |
| 5,857,452 | A | | 1/1999 | Troncoso | |
| 5,871,004 | A | | 2/1999 | Garvison | |
| 5,934,531 | A | | 8/1999 | Jablonic et al. | |
| 5,944,004 | A | * | 8/1999 | Goff et al. | 124/35.2 |
| 6,012,440 | A | * | 1/2000 | Grindle | 124/86 |
| 6,032,661 | A | * | 3/2000 | Goff et al. | 124/35.2 |
| 6,095,128 | A | * | 8/2000 | Bednar | 124/25 |
| 6,161,532 | A | * | 12/2000 | Goff et al. | 124/35.2 |
| 6,247,467 | B1 | | 6/2001 | Siegfried | |
| 6,267,278 | B1 | | 7/2001 | Bogart | |
| 6,606,984 | B2 | * | 8/2003 | Mugg | 124/35.2 |
| 6,651,642 | B1 | | 11/2003 | Powers | |
| 6,763,819 | B2 | | 7/2004 | Eckert | |
| 6,766,794 | B1 | * | 7/2004 | Bently | 124/35.2 |
| 6,951,071 | B1 | * | 10/2005 | Acosta et al. | 42/69.01 |
| 6,968,836 | B1 | * | 11/2005 | Kees | 124/35.2 |
| 7,165,543 | B2 | * | 1/2007 | Simo et al. | 124/44.5 |
| 7,240,672 | B2 | | 7/2007 | Peck et al. | |
| 7,314,045 | B2 | | 1/2008 | Eckert et al. | |
| 7,337,773 | B2 | * | 3/2008 | Simo et al. | 124/44.5 |
| 7,527,182 | B1 | | 5/2009 | Sherwood et al. | |
| 7,607,423 | B1 | * | 10/2009 | Kees et al. | 124/35.2 |
| 8,622,050 | B2 | * | 1/2014 | Goff et al. | 124/25 |
| 2004/0035406 | A1 | | 2/2004 | Egusquiza | |
| 2004/0079351 | A1 | | 4/2004 | Summers et al. | |
| 2006/0011189 | A1 | * | 1/2006 | Simo et al. | 124/86 |
| 2006/0042612 | A1 | | 3/2006 | Stanislawski | |
| 2006/0162707 | A1 | | 7/2006 | Peck et al. | |
| 2007/0137630 | A1 | | 6/2007 | Simo et al. | |
| 2008/0035135 | A1 | * | 2/2008 | Pardoski | 124/35.2 |
| 2008/0202487 | A1 | * | 8/2008 | Maleski et al. | 124/25 |
| 2010/0018512 | A1 | * | 1/2010 | Sandel | 124/25.6 |
| 2010/0170491 | A1 | * | 7/2010 | Roe | 124/44.5 |
| 2011/0303205 | A1 | * | 12/2011 | Goff et al. | 124/31 |

* cited by examiner

BOWSTRING DRAWING AND RELEASE ASSIST APPARATUS AND METHOD THEREOF

CROSS REFERENCE TO RELATED APPLICATION

This application is a divisional of U.S. patent application Ser. No. 13/367,677 filed on Feb. 7, 2012, which is a continuation of U.S. Patent Application Publication No. 2008/0302347 filed on Jun. 5, 2008, which claims priority from and the benefit of U.S. Patent Provisional Application No. 60/942,057 filed on Jun. 5, 2007, the entire contents of each of which are incorporated herein by reference.

BACKGROUND

1. Technical Field

The present disclosure relates generally to archery and, more specifically to devices facilitating one-handed operation of archery equipment. In particular the disclosure relates to one-handed loading, drawing and firing of an arrow from a bow.

2. Background of Related Art

The sport of archery has developed from ancient techniques whereby an archer projects an arrow from a bow toward a selected target. Archery remains popular today both as a means of hunting and also as a competitive sport. Technological developments in the equipment have added appeal to the sport by allowing for increased accuracy and ease of use.

One area of development has been in the field of release aids. Traditionally an archer would use her fingers to draw back an arrow and hold the bowstring in a fully drawn position while aiming. Inconsistencies in the drawing and release of the bowstring often unpredictably affected the trajectory of the arrow and led to inaccurate firing. A typical release aid is designed to reduce these inconsistencies and consequently improve accuracy. Many include a mechanical jaw operatively connected to a trigger mechanism to consistently engage and release the bowstring. A release aid will often include a swivel mechanism so that the archer will be able to fire the arrow from a comfortable position without devoting undue attention to the alignment of the release aid. Also, a wrist strap is often included allowing the archer to deliver the necessary forces to the mechanism to draw back the arrow.

Another area of development has been in bow drawlock devices. Traditionally an archer would need to exert a large force to bring a bowstring into a fully tensioned condition suitable for firing an arrow. Consequently, after releasing several arrows muscle fatigue would lead to inaccurate firing. A drawlock may be used to reduce muscle fatigue typically by providing either a fixed or moveable rod attached to the bow with a latch mechanism to lock the bowstring at a full draw.

One area needing further development is in providing archery equipment configured for one-handed or hands-free operation. Traditionally an archer would need to support the bow with one hand and with the other hand, draw the bowstring and fire the arrow. Firing accuracy may be improved, however if at least one hand remains free to perform other tasks such as sighting or ascertaining wind conditions. Also, there is significant interest in the sport of archery by those with limited or no use of a hand or arm. Thus, a need exists for equipment which will allow these individuals to enjoy the sport of archery.

SUMMARY

The present disclosure describes an apparatus that enables an archer to draw and fire an arrow or other projectile from a bow using only one arm. The apparatus comprises a release aid having jaws adapted for selective engagement and disengagement of a bowstring or string loop attached to the bowstring. The release aid includes a trigger mechanism operable to open and close the jaws. The apparatus also comprises a head gear configured for attachment to the head of an archer and a connection mechanism coupling the release aid to the head gear such that the archer may resist a tension in the bowstring with the headgear.

The head gear may comprise a stabilizing member configured to hold the release aid steady adjacent a mouth of the archer, and the trigger mechanism may comprises a trigger lever extending from the release aid that is operable by the mouth of the archer. The stabilizing member may also comprise a shoulder mount configured to maintain a position of the release aid as the tension is applied to the bowstring.

The trigger mechanism of the apparatus may comprise a lever release switch. The lever release switch may be configured for activation by a mouth of the archer.

The apparatus may further comprise a leg brace secured to a leg of the archer that provides a surface on which the archer may rest the bow in a position suitable for nocking an arrow. The leg brace may comprise an adjustment feature to permit adjustment of an overall length of the leg brace.

According to another aspect of the disclosure, an apparatus for drawing and firing an arrow from a bow comprises a drawbar coupled to the bow that is selectively moveable between an extended configuration and a retracted configuration. The apparatus also comprises an engagement head supported by the drawbar that is selectively moveable between an engaged configuration and a release configuration. The engagement head engages the bowstring when in the engaged configuration and is withdrawn from the bowstring when in the release configuration. The apparatus also comprises a power unit operatively connected to the drawbar. The power unit is configured for providing power to the drawbar to move the drawbar between the retracted and extended configurations, and to move the engagement head between the engaged and release configurations. The apparatus also comprises a first drawbar control and a second drawbar control. The first drawbar control is configured to move the drawbar from the retracted to extended configuration when the engagement head is in the engaged configuration such that the bow may be drawn, and the second drawbar control is configured to move the engagement head from the engaged to release configuration when the drawbar is in the extended configuration such that an arrow may be fired from the bow.

The first and second drawbar controls may both be operable by a hand on an extended forward arm of an archer. Alternatively, one of the first and second drawbar controls may be accessible by a hand on an extended forward arm of an archer, and the other of the drawbar controls may be configured for activation by the mouth of the archer.

The apparatus may further comprise a sensor electrically coupled to a control circuit may be configured to detect the presence or absence of an arrow from the bow, and the control circuit may be electrically coupled to the power unit and configured to prevent accidental movement of the drawbar from the retracted configuration to the extended configuration in the absence of an arrow from the bow. The apparatus may also further comprise a maintenance override implement to permit the drawbar to move from the retracted configuration to the extended configuration in the absence of an arrow, and to prevent accidental movement of the engagement head from the engagement to release configuration.

The drawbar may be coupled to a riser on the bow, or alternatively the drawbar may be coupled to a cable guard of a compound bow. Also, at least one of the drawbar, power unit and drawbar controls are selectively removable from the bow.

BRIEF DESCRIPTION OF THE DRAWINGS

The accompanying drawings, which are incorporated in and constitute a part of this specification, illustrate embodiments of the present disclosure and, together with the detailed description of the embodiments given below, serve to explain the principles of the disclosure.

DETAILED DESCRIPTION OF PREFERRED EMBODIMENTS

Figure 1A:
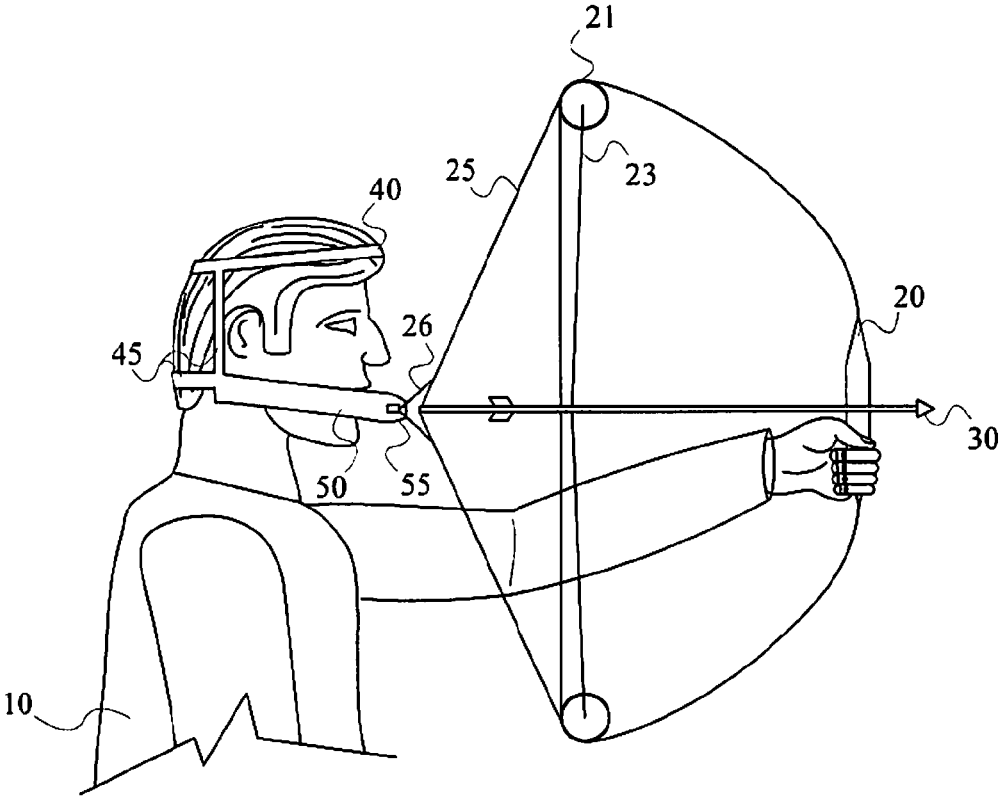
FIG. 1A is a side view of one illustrative embodiment constructed in accordance with the present disclosure.

The attached figures illustrate exemplary embodiments of the present disclosure and are referenced to describe the embodiments depicted therein. Hereinafter the apparatus will be described in detail by explaining the figures wherein like reference numerals represent like parts throughout the several views.

Referring initially to FIG. 1A, an archer 10 holds a bow 20 with a fully extended forward arm. Archer 10 wears head gear 40 having a connection means to release aid 50 which includes at least one stabilizing member 45. Stabilizing member 45 serves to maintain the position of release aid 50 adjacent to the mouth of archer 10. Release aid 50 engages string loop 26 on bowstring 25 with jaws 55 such that the bow 20 is fully drawn. Archer 10 may activate release aid 50 using her mouth to cause jaws 55 to open and release string loop 26 and bowstring 25 propelling arrow 30 forward toward a selected target (not shown).

Bow 20 is depicted as a compound bow, which may be recognized by the presence of eccentric pulleys 21 and cables 23. A compound bow represents a relatively complex environment for an embodiment of the present disclosure, but those skilled in archery will readily recognize how any embodiment of the present disclosure may be adapted to be installed on or used with other standard types of bows including a straight limb bow or a recurve bow. A string loop 26 is depicted attached to the bowstring 25 on both sides of the arrow 30. A string loop is a common disposable archery accessory which typically slides over the bowstring to protect the bowstring from unnecessary wear. Here it may also serve the purpose of providing additional space between the face of archer 10 and bowstring 25. Once released, bowstring 25 will move swiftly and often an archer 10 will feel more comfortable with some additional clearance.

Figure 1B:
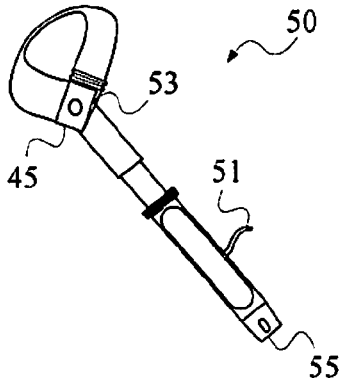
FIG. 1B is a close up view of a release aid which may be modified for use with the embodiment depicted in FIG. 1A.

Release aid 50 may be any type of commercially available release aid or modified from such a release aid. A suitable release aid for this application may be the Patriot model manufactured by Tru-Fire Release Co. of North Fond du Lac, Wis. as depicted in FIG. 1B. The jaws 55 on this model are normally biased in a closed position by a spring or other mechanism.

Figure 1C:
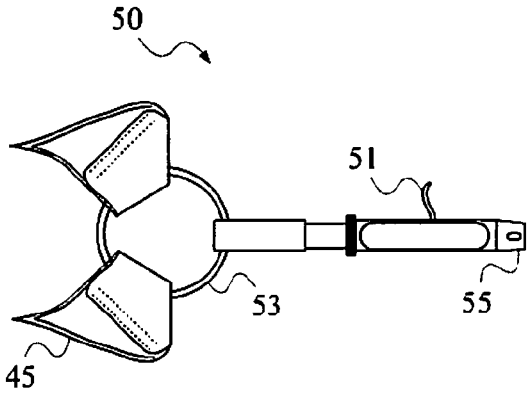
FIG. 1C is an alternate release aid which may be modified for use with the embodiment depicted in FIG. 1A.

A trigger lever release 51 extends from the body which would normally allow an archer to use a finger to open the jaws 55. Here, archer 10 may use her mouth, tongue or teeth to move the trigger lever release 51 and control the jaws 55. This facilitates the insertion of the bowstring in the un-drawn and un-tensioned position, and also the release of the bowstring from the fully drawn position. Commercially available release aids are often equipped with a wrist strap to assist in drawing back the arrow. The body of the release aid is connected to the wrist strap by a connection means 53 which may take the form of a bolt and nut combination as depicted in FIG. 1B. Other models may include other connection means 53 such as a connection ring as depicted in FIG. 1C. In any case, the connection means 53 may be used in making the connection to head gear 40. The wrist strap may also be modified to form part of stabilizing member 45. Otherwise, the wrist strap may be removed.

Archer 10 does not need to move the trigger lever 51 directly with her mouth as long as some means of controlling the jaws 55 with the mouth is provided. A mouth switch may be provided as either a mechanical or electrical device, but must be in communication with the jaws 55 of release aid 50. An electrical system may include a contact switch placed between the teeth such that an archer may bite down thereby closing a circuit sending an electrical signal to trigger jaws 55. The Bite Switch or the Tongue Switch manufactured by Conceptus Remote Switches Group of Scottsdale, Ariz. may be appropriately configured to serve as the means for controlling jaws 55. Alternatively, a mechanical system may include a flexible cable allowing a plunger depressed with the mouth at one end to cause a corresponding movement at the opposite end to trigger the jaws 55. As another alternative, a mouth switch may incorporate an infared emitter in electrical communication with a receiver placed in the release aid 50 and configured to release the trigger upon activation of the mouth switch.

Figure 1D:
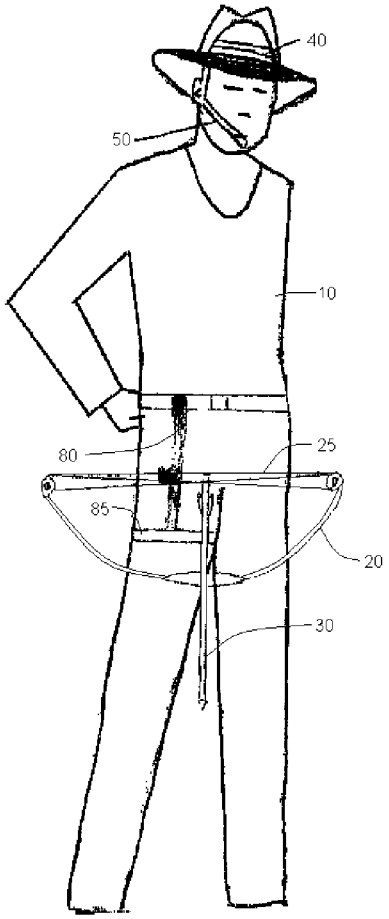
FIG. 1D is a front view of an illustrative embodiment of the present disclosure including a leg brace for use with the embodiment depicted.

Head gear 40 may include of a series of straps as depicted in FIG. 1A or may be integrated into a baseball cap or other conventional headwear as depicted in FIG. 1D. In any case, the head gear must extend to the back of the head and fit securely to allow the archer 10 to pull back against the tension in the bowstring 25. At least one stabilizing member 45 is connected to a portion of the head gear one end and to the release aid on the other. The stabilizing member 45 may be formed from a simple fabric strap, or may include rigid components which hold the release aid 50 steady. The stabilizing member 45 may further comprise a shoulder mount (not shown) that may maintain the position of the release aid 50 adjacent to the mouth of the archer 10 when the archer 10 draws back the bowstring 25. The shoulder mount may be configured to resist a tendency for the release aid 50 to move away from the mouth of the archer 10 as the bowstring is drawn back.

In operation, an archer 10 first dons the head gear 40 and nocks an arrow 30 into the bowstring 25. The archer 10 may be assisted in nocking the arrow 30 by a leg brace as described below or a floor stand which can hold the bow 20 upright and steady. Next the archer 10 engages the release aid 50 so that the jaws 55 close around the bowstring 25 or string loop 26. The bow 20 is then drawn back by extending the forward arm and simultaneously resisting the tension resulting in the head gear 40. When the archer is satisfied with the aim, she activates the jaws 55 of the release aid 50 to release the arrow toward the selected target.

Figure 1E:
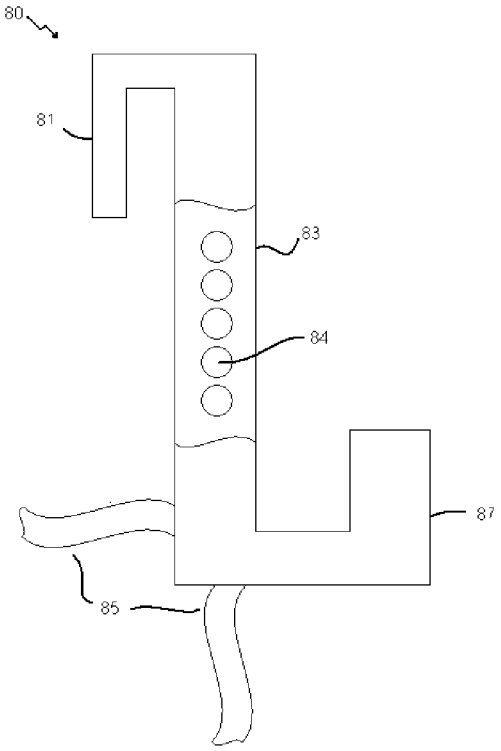
FIG. 1E is a close up side view of the brace depicted in FIG. 1D.

Now with reference to FIGS. 1D and 1E, a device which may be used to further assist the archer 10 in the one handed operation of the equipment described above will be discussed. FIG. 1D depicts an archer 10 wearing head gear 40 which has been incorporated into a hat. Leg brace 80 may be provided which can hook onto the belt or pants of the archer 10. The leg brace 80 provides a surface on which the archer 10 may rest the bow 20 by the bowstring 25 or other component in a convenient position for nocking the arrow 30 with an available hand. A leg strap 85 may be attached to the leg brace 80 to stabilize the leg brace 80. As can be seen in FIG. 1E, leg brace 80 includes a belt hook portion 81 and a bow hook portion 87 connected by an adjustment section 83. The belt hook portion 81 and the bow hook portion 87 are preferably formed from a strong rigid material and may be wrapped in leather to prevent scratching the archer 10 or bow 20. The adjustment section 83 may be formed from Velcro® or include metal buttons 84 to provide some means of adjusting the overall length of the leg brace 80. This will allow the archer 10 to hang the bow 20 at the level most convenient for nocking the arrow with a single hand. The leg brace may be attached in a forward location as depicted in FIG. 1D or may be attached on the side of the leg according to the preference of the archer 10.

Figure 2A:
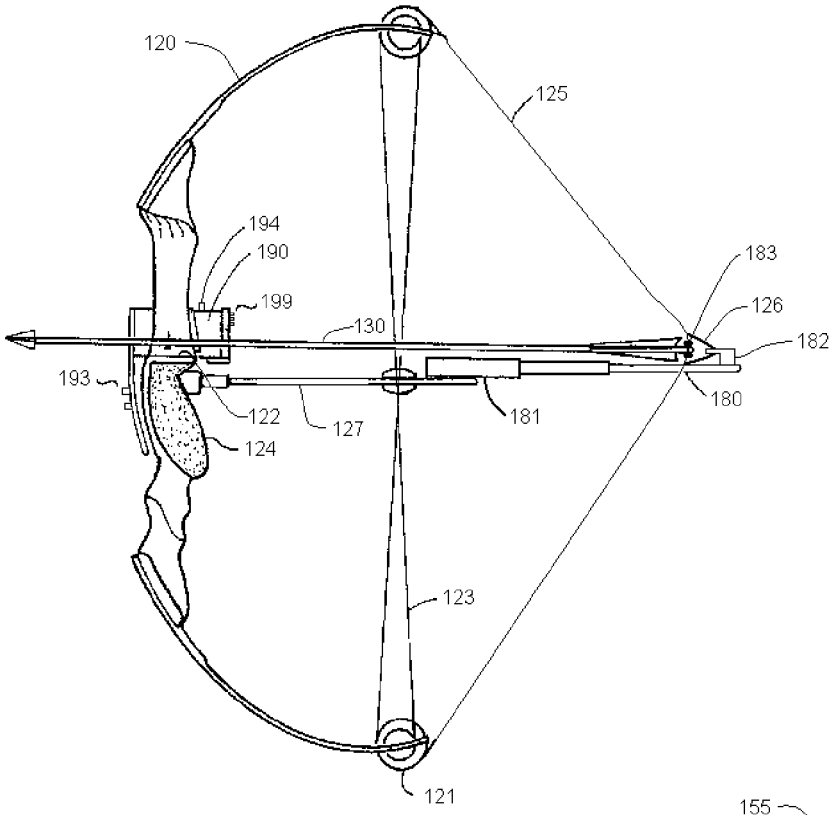
FIG. 2A depicts another illustrative embodiment wherein the bowstring is drawn back with an automatic drawbar device.

In another embodiment, the arrow is drawn back with an automatic drawbar 180 as depicted in FIG. 2A. Once again, this embodiment is depicted in the environment of a compound bow 120 characterized by eccentric pulleys 121 and cables 123. The arrow 130 is nocked in bowstring 125 in a fully drawn position. Again, an optional string loop 126 is depicted attached to the bowstring on both sides of the arrow 130.

Figure 2B:
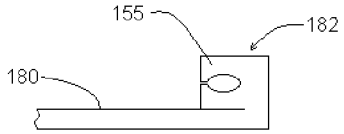
FIG. 2B is a close up top view of a jaw head which may be used as the engagement head of FIG. 2A.
Figure 2C:
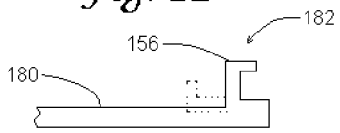
FIG. 2C is a close up top view of a hook head which may be used as an alternative to the jaw head of FIG. 2B.

The string loop 126 is engaged by an engagement head 182 attached near an end of drawbar 180. The engagement head 182 preferably incorporates a pair of jaws 155 as depicted in the jaw head of FIG. 2B. The jaws 155 are very similar in construction and operation as the jaws of a commercial release aid discussed above. Alternatively, engagement head 182 may incorporate a hook 156 as depicted in the hook head of FIG. 2C. The hook may be adapted to move between an engagement position whereby the hook can engage the bowstring 125 to bring the bow to a drawn position, and a release position whereby the hook pivots, retracts or withdraws to release the bowstring 125. String loop 126, is preferably used only with a jaw head where there is less chance of entanglement with the surrounding equipment.

Also included is arrow sensor 183 which may be attached to bowstring 125 or in another suitable position. Arrow sensor 183 may be an optic sensor or another type of sensor configured to detect the presence or absence of an arrow 130 from the bow. The arrow sensor 183 can be electrically connected to a control circuit designed to prevent the engagement head 182 from releasing the bowstring 125 from a fully drawn position in the absence of an arrow. This type of dry fire could damage the bow 120 and injure the archer.

Opposite the engagement head 182, the drawbar 180 includes a telescoping portion 181. The telescoping portion 181 allows the drawbar to extend to a length necessary to bring the bowstring 125 to a fully drawn position as shown, and also to retract to a length appropriate for the engagement head 182 to engage the bowstring 125 in a fully relaxed position. The drawbar 180 should be positioned to the side of the bowstring 125 such that it does not interfere with the placement of a hand on the hand rest 124 or the motion of the bowstring 125, cables 123 or arrow 130. Also the drawbar 180 is preferably placed near and just below the position of the arrow 130 to facilitate the proper placement and alignment of the arrow 130 at full draw. The drawbar 180 may thus be coupled to a riser on the bow. Alternatively, the drawbar 180 may extend from a cable guard 127, from arrow rest 122 or from any other appropriate connection point. A cable guard 127 is often provided with a compound bow 120 as a standard component to protect the cables 123 and may extend much of the distance from the hand rest 124 required of the drawbar 180. This makes a cable guard a preferable attachment point for the drawbar 180 because it may reduce the length and weight required of the drawbar 180, thus minimizing the disruption to the traditional archery bow profile. As an alternative, or in combination with telescoping portion 181, the drawbar 180 may include hinges or pivots allowing for movement between the two relevant positions.

Attached to the bow handle and operatively connected to drawbar 180 is power unit 190. This may be an electrical or pneumatic center configured to extend and retract the drawbar 180. It may be attached to the bow handle as shown or formed as an integral part of the bow handle. An integrated design is preferred which least upsets the traditional balance and shape of a traditional bow. Indicator lights 199 may include green, yellow and red lights to indicate that the remaining power is sufficient, dwindling, or insufficient respectively. The indicator lights 199 will assist in the prevention of an accidental misfire in the event of insufficient power. Also operatively connected to the power unit are drawbar controls 193. These should be disposed on or near the hand rest 124 so that the archer may access them using the hand on a fully extended forward arm. Drawbar controls 193 should include at least two buttons or switches. As shown these include a first drawbar extension button and a second engagement head release button. The first button may activate the drawbar 180. With an arrow in place, depressing the first button would first cause engagement head 182 to engage the bowstring 125, and second cause the drawbar to extend drawing the bow. With the bow at a full draw, depressing the second may first cause the engagement head 182 to release the bowstring 125 firing the arrow, and secondly retract the drawbar 180 to return the bow to a configuration for preparing for a subsequent shot. To promote safety, the second drawbar control may be located a sufficient distance from the first such that accidental activation of both controls and a resulting unexpected firing of an arrow is unlikely. An alternative configuration places the controls 193 in a remote location such as on a mouth switch, as described above, which does not require the archer to use a hand to activate.

Sensor 183 may also be electrically connected to a control circuit configured to prevent the accidental extension of the drawbar 180 in the absence of an arrow. It is preferred during normal firing and use that bow 120 remains undrawn until an arrow 130 is inserted. There are some instances, however, when the drawbar 180 may need to draw the bow 120 without an arrow 130. These include measuring an archer's draw length, measuring a bow's draw weight, assessing proper arrow weights and lengths, and for regular maintenance and service purposes. To accommodate this type of occasional use, a maintenance override implement 194 may be provided to allow the drawbar to draw the bow, but still prevent the engagement head 182 from releasing the bowstring 125 as discussed above. Maintenance override implement 194 may take the form of a button to be used in conjunction with drawbar controls 193 such that two buttons must be depressed simultaneously in order allow the drawbar to be drawn in the absence of an arrow. Alternatively, an independent button may be provided which can cause the drawbar to extend regardless of whether an arrow is detected by sensor 183. In either case, maintenance override implement 194 should be located remotely with respect to controls 193 to prevent accidental activation.

In normal operation, the archer nocks the arrow 130 on the bowstring 125 allowing a forward portion to rest on the arrow rest 122. Any standard arrow rest such as a whisker biscuit, or a simple shelf 122 provided with the bow may be used to support the forward portion while the archer prepares to fire. With the drawbar 180 in the retracted position, the archer may then press the first drawbar extension button 193 allowing the jaws 155 or hook 156 to engage the bowstring 125 or the string loop 126 and then extend the drawbar 180 to draw the bow 120. The aiming may be accomplished by supporting the bow 120 with an extended forward arm, or with the aid of floor stand (not shown). Finally, the archer presses the engagement head release button 193. The arrow sensor 183 should detect the presence of arrow 130 and allow the engagement head 182 to disengage the bowstring 125 or string loop 126 thereby firing the arrow toward the selected target. The drawbar 180 may then automatically retract to ready the system for another shot. An archer may perform each of these tasks in sequence using only a single arm.

In another aspect of the disclosure, the drawbar 180 or other components associated with the drawbar 180 are configured to permit the traditional two handed usage of the bow 120. For instance, drawbar 180, engagement head 182, sensor 183, power unit 190 and controls 193 may all be removable from the bow 120 leaving all conventional components of bow 120 intact to allow for the conventional two handed firing. Alternatively, these components may be configured such that their placement on the bow 120 does not interfere with conventional firing. The system may then be turned off configure it for conventional firing. Providing archery equipment configurable for both single handed operation and conventional dual handed operation allows a bow to be shared among a greater number of archers. This may make them more attractive to ranges that cater to a diverse clientele.

The above description should not be construed as limiting, but merely as exemplifications of preferred embodiments. Those skilled in the art will envision other modifications within the scope and spirit of the disclosure.

What is claimed is:

1. A method for operating an apparatus for drawing and firing an arrow from a bow, comprising:

providing an apparatus including:

a drawbar coupled to the bow, the drawbar selectively moveable between an extended configuration and a retracted configuration;

an engagement head supported by the drawbar;

a power unit operatively connected to the drawbar; and a first drawbar control and a second drawbar control operatively connected to the power unit;

activating the first drawbar control such that the drawbar is moved from the retracted to the extended configuration when the engagement head is in an engaged configuration such that the bow may be drawn;

activating the second drawbar control such that the drawbar is moved from the engaged configuration to the release configuration when the engagement head is in a release configuration such that an arrow may be fired from the bow; and wherein one of the first and second drawbar controls is activated by a mouth or hand of an archer.

2. The method according to claim 1, wherein the first and second drawbar controls are accessible by a hand on an extended forward arm of an archer.

3. The method according to claim 1, wherein one of the first and second drawbar controls is accessible by a hand on an extended forward arm of an archer, and the other of the drawbar controls is configured for activation by the mouth of the archer.

4. The method according to claim 1, further comprising a sensor electrically coupled to a control circuit, the sensor configured to detect the presence or absence of an arrow from the bow, the control circuit electrically coupled to the power unit and configured to prevent accidental movement of the drawbar from the retracted configuration to the extended configuration in the absence of an arrow from the bow.

5. The method according to claim 4, further comprising a maintenance override implement to permit the drawbar to move from the retracted configuration to the extended configuration in the absence of an arrow, and to prevent accidental movement of the engagement head from the engagement to release configuration.

6. The method according to claim 1, wherein the drawbar is coupled to a riser of the bow.

7. The method according to claim 1, wherein the drawbar is coupled to a cable guard of a compound bow.

8. The method according to claim 1, wherein at least one of the drawbar, power unit and drawbar controls is selectively removable from the bow.

* * * * *